US010948271B1

(12) United States Patent
Xiaowen et al.

(10) Patent No.: US 10,948,271 B1
(45) Date of Patent: Mar. 16, 2021

(54) COLD FIREWORKS

(71) Applicants: Zhou Xiaowen, Liuyang Hunan (CN); Steve Bruce Freedman, Lake Worth, FL (US)

(72) Inventors: Zhou Xiaowen, Liuyang Hunan (CN); Steve Bruce Freedman, Lake Worth, FL (US)

( * ) Notice: Subject to any disclaimer, the term of this patent is extended or adjusted under 35 U.S.C. 154(b) by 0 days.

(21) Appl. No.: 16/178,246

(22) Filed: Nov. 1, 2018

Related U.S. Application Data

(60) Provisional application No. 62/639,769, filed on Mar. 7, 2018, provisional application No. 62/590,186, filed on Nov. 22, 2017, provisional application No. 62/621,167, filed on Jan. 24, 2018, provisional application No. 62/533,782, filed on Jul. 18, 2017.

(51) Int. Cl.
*F42B 4/18* (2006.01)
*F42B 4/20* (2006.01)
*A63J 5/02* (2006.01)

(52) U.S. Cl.
CPC ..... *F42B 4/18* (2013.01); *F42B 4/20* (2013.01); *A63J 5/02* (2013.01)

(58) Field of Classification Search
CPC ..... F42B 4/18; F42B 4/20; F42B 4/00; A63J 5/02; A63J 5/00
USPC ..... 102/355
See application file for complete search history.

(56) References Cited

U.S. PATENT DOCUMENTS

2004/0113300 A1* 6/2004 Jurgens ..... B01J 2/04 264/9
2011/0033805 A1* 2/2011 Multamaki ..... A63J 5/023 431/8
2018/0238664 A1* 8/2018 Chen ..... F42B 4/00

FOREIGN PATENT DOCUMENTS

CN 2872289 * 2/2006
CN 205784897 * 5/2016
CN 105854317 * 6/2016
WO WO-2017075890 A1 * 5/2017 ..... F42B 4/24
WO WO-2017075892 A1 * 5/2017 ..... F42B 4/26
WO WO-2017206525 A1 * 12/2017 ..... A63J 5/02
WO WO-2018133396 A1 * 7/2018 ..... F42B 4/18
WO WO-2019028956 A1 * 2/2019 ..... F42B 4/18
WO WO-2019137198 A1 * 7/2019 ..... F42B 4/18
WO WO-2019148595 A1 * 8/2019 ..... F42B 4/18

* cited by examiner

*Primary Examiner* — Joshua E Freeman
(74) *Attorney, Agent, or Firm* — Saul Ewing Arnstein & Lehr LLP; Brian R. Landry

(57) ABSTRACT

A cold spark fire electronic eruptive apparatus characterized in that the erupting apparatus is comprised of an ejecting unit, an activation unit, a power unit, and a storage unit, wherein, the storage unit stores a cold fireworks material for discharge, the power unit is connected to the storage unit and also is connected with a heating unit, the power unit transmitting the cold fireworks material in the storage unit to the heating unit, and the heating unit activating the cold fireworks raw material, sending it to the air removal unit for eruption.

18 Claims, 4 Drawing Sheets

COLD FIREWORKS

CROSS-REFERENCE TO RELATED APPLICATION

This application claims the benefit of U.S. Provisional Patent Application Ser. No. 62/533,782, filed Sep. 1, 2017, and U.S. Provisional Patent Application Ser. No. 62/621,167, filed Jan. 24, 2018, and U.S. Provisional Patent Application Ser. No. 62/590,186, filed Nov. 22, 2017, and U.S. Provisional Patent Application Ser. No. 62/639,769, filed Mar. 7, 2018 which are incorporated herein in their entireties.

FIELD OF THE INVENTION

The present invention relates to the technical field of fireworks, and in particular to equipment for cold fireworks.

BACKGROUND OF THE INVENTION

Fireworks have been a tradition through time, often used in stage performances, for celebrations, and at venues. As fireworks are normally discharged through gunpowder, the resulting explosions release intense smoke, heat, and an irritating smell. The smoke and other byproducts are pollutants to the environment and create safety issues. In recent years, such safety issues have become more apparent, resulting in stricter safety guidelines for firework performances.

Traditional pyrotechnics and fireworks require heating of gunpowder and operate at extreme levels of heat. The explosion required to discharge such pyrotechnics operates as a fire hazard and expels intense smoke, carcinogens, and noxious smells into the immediate environment. As a result of these side effects, traditional pyrotechnics are generally regulated to outdoor environments or large arenas for the sake of audience safety and to reduce the risk of fire.

Cold pyrotechnics, also known in the industry as non-pyrotechnics or cold fireworks, on the other hand, implement a relatively cool chemical reaction, as opposed to a gunpowder explosion, to discharge sparks. In the field of pyrotechnics, such cold pyrotechnics are considered much safer than traditional pyrotechnics, and are regularly implemented indoors due to their low fire risk and minimized smoke discharge.

Various devices for discharging such cold pyrotechnics include the device disclosed in Chinese patent CN2872289, which is a motor-driven device for producing an oscillating or rotating cold fireworks spout, the device disclosed in Chinese patent CN205784897, which is a cold fireworks device further incorporating a materials storage unit, and the device disclosed in Chinese patent CN105854317, which is a cold fireworks device further incorporating a cutting mechanism and a blower mechanism.

All three of the above patents disclose devices capable of discharging cold pyrotechnics with good display effects, though they comprise overly complex structures that increase weight and reduce cost efficiency. The increased weight and complexity of the designs also is not amenable to the portability and installation of the devices, and the third design is incapable of creating a waterfall (downward eruption) effect required in many venues or situations.

Therefore, there is an urgent need to increase firework safety, and a need in the art for a cold firework device that is conveniently transported and installed, and may emit cold fireworks in any orientation.

SUMMARY OF THE INVENTION

This summary is provided to introduce a selection of concepts in a simplified form that are further described below in the detailed description. This summary is not intended to identify key features or essential features of the claimed subject matter, nor is it intended to be used to limit the scope of the claimed subject matter. Furthermore, the claimed subject matter is not limited to implementations that solve any or all disadvantages noted in any part of this disclosure.

In view of the aforementioned safety and environmental issues, it is an object of the present invention to provide a cold fireworks electronic eruption device which is simple in structure, easy to utilize, small in form factor, and convenient for transportation and installation.

Another object of the present invention is to propose a cold fireworks electronic eruption apparatus which can achieve the discharge of cold fireworks by using simple components, which are safe and environmentally friendly. Along with this, would be a simple structure, lower production costs, and many mechanical advantages to previous designs (as mentioned above).

In order to achieve the above object, the technical solution of the present invention is:

A fireworks electronic eruption device comprising an eruption unit, a heating unit, a power unit, and a storage unit. The storage unit stores a cold fireworks material for discharge, the power unit is connected to the storage unit and a fuel storage unit is connected with the heating unit. The power unit transmits the cold fireworks raw material in the storage unit to the heating unit, the heating unit heats the cold fireworks raw material (i.e. activates or excites the material) and sends it to an eruption unit, and is expelled by the eruption unit therein producing the cold fireworks discharge effect.

The cold fireworks discharge effect may be a visual effect (e.g. special effect) caused by a hot material such as heated powdered metal, or molten or glowing hot metal, being subjected to airflow, which causes a visual artifact that appears to be a spark.

The power unit is also connected to an ejecting unit for supplying power (e.g. force, or pressure) to the eruptive unit so that the cold fireworks can be ejected.

Further, the power unit is initialized by a blower or compressed air to provide pneumatic power to the storage unit and the eruption unit so as to initialize the effect of transporting the cold fireworks raw material and cause the eruption of cold fireworks.

The storage unit is a storage silo, and the storage silo is filled with a cold fireworks raw material such as a metal powder (e.g. a composite titanium powder or other metal particles).

The power unit is connected to an upper part of the silo through a duct to effectively blow the metal powder or the metal particles so that the metal powder or the metal particles can smoothly enter the heating unit.

A conveying pipe is connected with the silo, and the conveying pipe is connected with the heating unit. The metal powder or the metal particles are discharged through the side of the silo to facilitate the output of the metal powder or the metal particles.

The heating unit is composed of a heating coil and a heating pipe. The heating pipe is a hollow metal pipe, and the heating coil is a heating coil which is a commonly used electric heating wire.

Further, the heating pipe is vertically arranged to be connected to the conveying pipe, and the outer wall of the conveying pipe is provided with a discharge port such that pneumatic pressure in the conveying pipe is released. Thus, the metal powder or the metal particles discharged from the silo may have sufficient time to slow down and fall due to gravity. This reduces the falling rate of the metal particles, so that metal powder or metal particles have sufficient time to be heated.

The heating unit is connected with an adjusting mechanism, and the adjusting mechanism is connected with the eruptive unit, and the cold fireworks raw material heated by the heating unit is sent to the eruptive unit by a regulating mechanism such that the eruptive unit can emit cold fireworks.

More specifically, the adjusting mechanism is a regulating pipe. A middle of the regulating pipe is connected with a lower part of the heating pipe. A first end of the regulating pipe is connected with the eruption unit, a second end is vacant and a suspended end has an opening.

The eruption unit is a vertically arranged eruption (i.e. ejection) pipe having at least two upper and lower segments each having a different inner diameter and an inner diameter of the lower section smaller than an inner diameter of the upper section.

Further, the regulating pipe is connected to a lower portion of the eruption pipe. The inner diameter of the regulating pipe is larger than the inner diameter of the lower portion of the eruption pipe so that an impingement tube may generate suction by combining the inner diameter difference in an eruption pipe resulting in the effect of cold fireworks eruption.

Further, the air outlet of the blower is provided with a diverging mechanism having two tuyere ports, a first tuyere connected to the air duct and a second tuyere connected to the lower section of the eruption pipe.

Further disclosed is a cold fireworks electronic eruption device comprising an eruption unit, a pneumatic unit (e.g. compressed air or blower or similar device), a heating unit, a conveying unit and a material silo. The silo stores a cold fireworks raw material for discharging. The silo is connected to the heating unit to transmit the cold fireworks raw material to the heating unit. The conveying unit connects at least the heating unit and the silo, transmitting the cold fireworks raw material of the silo to the heating unit. The pneumatic unit connects the eruption unit, and the heating unit. The cold fireworks raw material is heated and then sent to the eruptive unit. The eruptive unit emits the cold fireworks raw material, which is heated under the action of the pneumatic unit, thereby forming the effect of the cold fireworks discharge.

The pneumatic unit is connected to the silo for blowing the cold fireworks stored in the silo to the heating unit.

Further, the air blowing unit is initialized by a blower or compressed air to provide pneumatic power to the silo and the eruption unit so as to initialize the effect of conveying cold fireworks raw materials and cause eruption of cold fireworks.

The invention has the characteristics of simple structure, is easy to realize, has a small volume and good handling, and is convenient for buried transportation and installation. The use will not take up too much space (for example, it can be in the stage, not exposed to the stage surface, not affecting the stage performance). Through the structural improvement, the equipment provides safety and environmental protection and achieves low cost of manufacture.

Further disclosed is a cold spark electronic eruptive apparatus characterized in that the erupting apparatus is comprised of an ejecting unit, an activation unit, a power unit and a silo. The silo stores a cold fireworks material for discharge. The power unit is connected to the silo and also is connected with the heating unit. The power unit transmits the cold fireworks raw material in the silo to the heating unit, the heating unit activates, heats, or excites, the cold fireworks raw material then sends it to the air removal unit (blower) for eruption.

In another aspect, the eruptive apparatus is characterized in that the power unit is further connected to an ejecting unit for supplying power to the ejecting unit so that the cold fireworks are ejected.

In another aspect, the eruptive apparatus is characterized in that said power unit is implemented by a blower or compressed air to provide wind power to the silo and the ejecting unit, thereby effecting the delivery of cold fireworks raw materials and the ejecting of cold fireworks.

In another aspect, the apparatus is characterized in that said storage unit is a silo containing a cold fireworks material, said power unit being connected to the stock (an upper part of the silo) and connected with a conveying pipe on a side wall of the storage silo, the conveying pipe being connected with the heating unit, and the cold fireworks raw material being discharged through the side of the storage silo.

In another aspect, said heating means is constituted by a heating coil and a heating pipe, said heating pipe being a hollow metal pipe having an outer coil wound with a heating coil, the heating coil is a commonly used electric wire.

In another aspect, the apparatus is characterized in that said heating pipe is arranged vertically to be connected to a conveying pipe and a suction port is provided on the outer wall of the conveying pipe so that air pressure in the conveying pipe gets released.

In another aspect, said heating unit is connected with an adjustment mechanism, said adjustment mechanism being connected to the eruption unit. The adjustment mechanism is a regulating pipe. A middle portion of said regulating pipe is connected to a lower part of the heating pipe, a first end of the regulating pipe is connected with the eruptive unit, a second end is vacant and a suspended end has an opening.

In another aspect, the apparatus is characterized in that said eruption unit is a vertically arranged eruption pipe having at least two upper and lower sections having different inner diameters, the inner diameters of the lower section being less than the diameters of the upper section.

In another aspect, said regulating pipe is connected to the lower section of the eruption pipe and the inner diameter of the regulating pipe is larger than the inner diameter of the lower portion of said eruption pipe.

In another aspect, the apparatus is characterized in that the outlet of said blower or compressed air nozzle is provided with a diverging mechanism having two tuyere ports, one tuyere connected to the duct at the lower or upper part of the eruption pipe.

As another example, disclosed is a special effects device for ejecting sparks, the device comprising: an eruption unit, an activation unit, a power unit, a storage unit configured to store a source material, wherein the power unit is connected to the storage unit and the storage unit is connected to the activation unit, wherein the power unit is configured to transmit the source material from the storage unit to the activation unit, wherein the activation unit is configured to excite the source material to an excited state and send excited source material to the eruption unit, wherein the eruption unit is configured to eject the excited source material via pressure applied by the power unit, wherein the source material is configured to adopt the appearance of a spark by being subjected to airflow while the source material is in an excited state.

In another aspect, the source material includes a powdered metal.

In another aspect, exciting the source material causes the source material to be heated inside the device.

In another aspect, exciting the source material causes the source material to be heated to a glowing state inside the device.

In another aspect, the power unit is configured to concurrently transmit source material from the storage unit to the activation unit and apply pressure to the eruption unit to eject excited source material received from the activation unit.

In another aspect, the power unit is connected to an upper part of the storage unit through a duct to such that the source material smoothly enters the activation unit.

In another aspect, a conveying pipe is connected to the storage unit, and the conveying pipe is connected to the activation unit such that the source material is discharged through a side of the storage unit.

In another aspect, the activation unit includes a heating coil and a heating pipe, and the heating pipe is vertically arranged to be connected to the conveying pipe, and an outer wall of the conveying pipe includes a discharge port such that pneumatic pressure in the conveying pipe is released such that the source material has sufficient time to be excited in the activation unit.

In another aspect, the activation unit is connected to an adjusting mechanism, and the adjusting mechanism is connected to the eruption unit, such that the source material that is excited by the activation unit is sent to the eruption unit by a regulating mechanism such that the eruption unit can eject excited source material, wherein the adjusting mechanism includes a regulating pipe, where a middle of the regulating pipe is connected to a lower part of an activation tube of the activation unit, and such that a first end of the regulating pipe is connected to the eruption unit, and a second end of the regulating pipe is open.

In another aspect, the eruption unit is a vertically arranged pipe having at least an upper segment and a lower segment, each segment having a different inner diameter and an inner diameter of the lower section being smaller than an inner diameter of the upper section.

In another aspect, the regulating pipe is connected to a lower portion of the eruption unit, and an inner diameter of the regulating pipe is larger than an inner diameter of the lower portion of the eruption unit.

In another aspect, a diverging mechanism is included having two tuyere ports, a first tuyere port being connected to the duct that connects the power unit to the storage unit, and a second tuyere port connected to a lower section of an eruption pipe of the eruption unit.

These and other objects, features, and advantages of the present invention will become more readily apparent from the attached drawings and the detailed description of the preferred embodiments, which follow.

BRIEF DESCRIPTION OF THE DRAWINGS

The preferred embodiments of the invention will hereinafter be described in conjunction with the appended drawings provided to illustrate and not to limit the invention, where like designations denote like elements, and in which.

Like reference numerals refer to like parts throughout the several views of the drawings.

DETAILED DESCRIPTION

The following detailed description is merely exemplary in nature and is not intended to limit the described embodiments or the application and uses of the described embodiments. As used herein, the word "exemplary" or "illustrative" means "serving as an example, instance, or illustration." Any implementation described herein as "exemplary" or "illustrative" is not necessarily to be construed as preferred or advantageous over other implementations. All of the implementations described below are exemplary implementations provided to enable persons skilled in the art to make or use the embodiments of the disclosure and are not intended to limit the scope of the disclosure, which is defined by the claims. For purposes of description herein, the terms "upper", "lower", "left", "rear", "right", "front", "vertical", "horizontal", and derivatives thereof shall relate to the invention as oriented in FIG. 1. Furthermore, there is no intention to be bound by any expressed or implied theory presented in the preceding technical field, background, brief summary or the following detailed description. It is also to be understood that the specific devices and processes illustrated in the attached drawings, and described in the following specification, are simply exemplary embodiments of the inventive concepts defined in the appended claims. Hence, specific dimensions and other physical characteristics relating to the embodiments disclosed herein are not to be considered as limiting, unless the claims expressly state otherwise.

The present invention will now be described in further detail with reference to the accompanying drawings and the accompanying drawings, in which the objects, advantages and advantages of the present invention will become more apparent. It is to be understood that the specific embodiments described herein are merely illustrative of the invention and are not intended to limit the invention.

Figure 1:
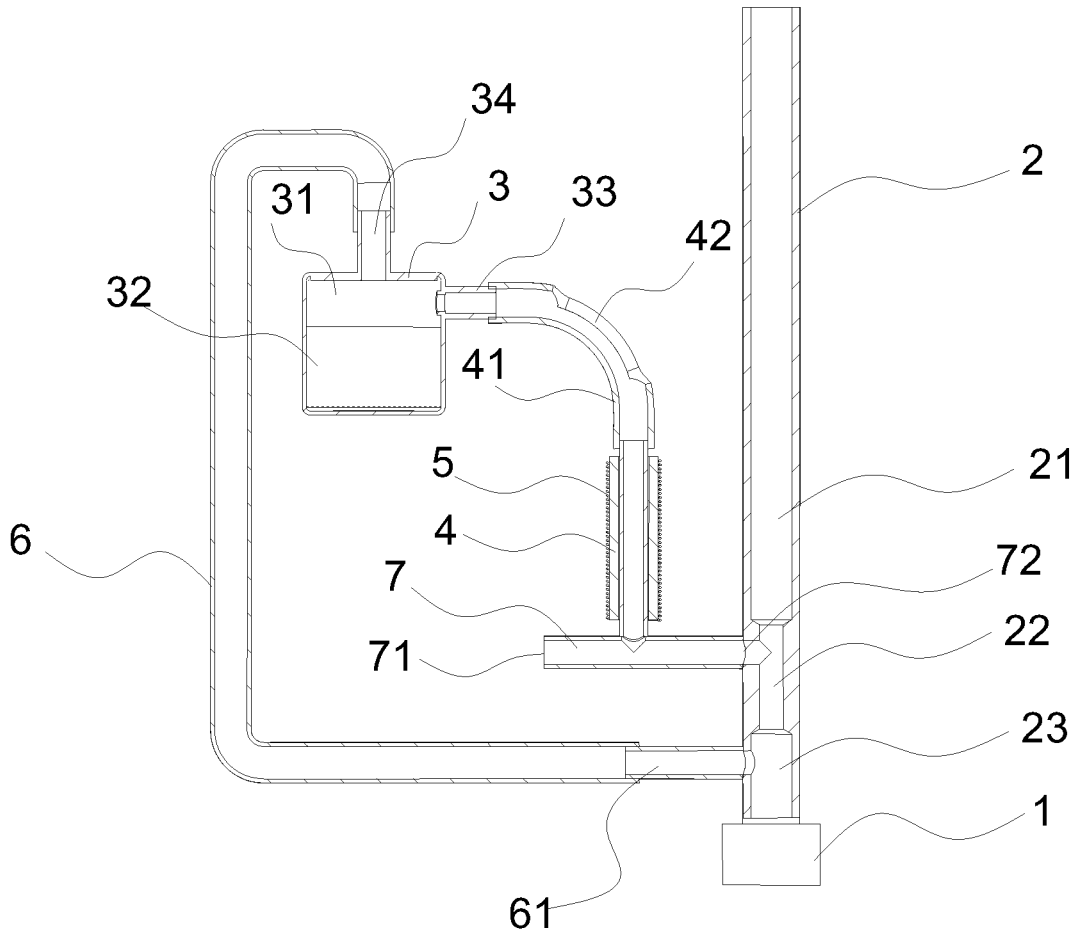
FIG. 1 is a schematic view of the structure of the present invention.

The illustration of FIG. 1 shows an apparatus that may be referred to as a cold spark, cold firework, non-pyrotechnic, or cold pyrotechnic eruptive apparatus for ejecting preheated cold firework material realized by the present invention. The apparatus includes a power unit 1 realized (i.e. shown) by a blower 1, which is realized by a silo tank 3, which is realized by a heating pipe 4 and a heating coil 5. The eruptive apparatus is realized by an eruption pipe 2.

The silo 3 stores a cold fireworks material 32 for discharge, and the blower 1 is connected to the silo 3 through a duct 6 connected to the heating pipe 4 through a conveying pipe 41, and the blower 1. The cold fireworks raw material 32 in the silo 3 is conveyed to the heating pipe 4 and the heating coil 5 is used to heat the cold fireworks material 32 to form a spark when the material 32 is exposed to airflow, and the spark is conveyed to the eruption pipe 2 through a regulating pipe 7, then at the eruption pipe 2 the heated material is erupted, thereby forming the effect of cold spark discharge.

It is to be understood that the cold spark discharge is not executed by combusting a fuel such as gunpowder or other traditional firework materials, and instead is executed by heating the cold firework material to an appropriate degree (e.g. 500-600 degrees Celsius) such that heated cold firework material is excited (i.e. activated) in the heating unit, and such that the heated cold firework material may be subsequently ejected. When the heated cold firework material is ejected, airflow causes the heated cold firework material to emit, or cause the appearance of, sparks (cold sparks). The material may be any appropriate material, such as titanium powder, zinc powder, zirconium powder, or a combination thereof. The heated cold firework material undergoes rapid oxidation when exposed to airflow (e.g. oxygen). This may be referred to as a "pyrosimulation" effect which means no flames are actually created, and the appearance of traditional fire or sparks is merely simulated.

Further, it is to be understood that the term "spark" may refer to a small glowing particle, or in some examples a visual effect or appearance of a spark.

In some instances, the emitted cold sparks (cold spark effect) may be cool enough for a user to touch without burning their hand. Such cold spark effect may be generally referred to as a cold spark special effect, a touch-safe spark special effect, a non-pyrotechnic spark special effect, or a pyrosimulation special effect, without departing from the spirit and scope of this disclosure.

The cold spark material may contain no chemical binders as found in typical fireworks. The material may be heated to a glowing or molten state in the device, which may be referred to an "activated" or "excited" state. In a cross-referenced priority document to this disclosure, such a state is referred to as "ignited" but it is to be understood that the material is not ignited as defined in plain English, and is instead merely heated. Further, the term "combustion" may have been used in a cross-referenced priority document to this disclosure, but such term is not to be understood in its plain English meaning, and is instead to be understood as "heating", "activating", or "exciting". Such terms should be understood in the context of "cold fireworks" or "cold pyrotechnics" as showcased in the industry and field of fireworks, pyrotechnics, and/or special effects.

It is to be understood that the term "cold fireworks" may refer to non-gunpowder pyrotechnics that do not use gunpowder or other explosives, and instead provides sparks by way of heating a material and exposing the material to atmosphere to cause the material to spark. Any appropriate phenomenon may cause the cold spark effect. But the sparks are not typical sparks seen from traditional combustive fireworks that would burn a user's hand. The material may be a metal powder having an appropriate particle size to provide the cold spark effect. The particles may be super heated and super cooled to cause the cold spark effect. For example, in the heating unit (ignition unit) the particles may be heated to approximately 585 degrees Celsius, or above 565 degrees Celsius, and may be cooled to room temperature rapidly, causing the cold spark effect when the material is exposed to air. Rapid oxidation may cause this effect. And a bi-product may be a respective metal-oxide (e.g. titanium oxide, zinc oxide). One or a combination of air flow, cooling, and particle size may be appropriate factors for causing the cold spark effect. The material may be approximately 95% titanium and 5% zirconium.

It is to be understood that the term "cold fireworks" is to be interpreted in the scope of the industry, and is not meant to define an exact temperature. For example, a cold firework material is not combusted in the heating chamber, and is merely heated, and does not contain chemical binders.

Activating (heating) the cold firework material may include heating the material to at least 560 degrees Celsius. But it is to be understood that temperatures stated herein may range plus or minus 20 degrees Celsius and all degrees in-between such range. The range may also vary such that an ejected spark is not above 120 degrees Fahrenheit. The material may be heated such that it is glowing or molten in the device. The heated material rapidly cools during transport through the device (due to a specially selected thermal mass, heat capacity, and/or conductivity) before being ejected, and may cool to a degree in the range of room temperature to a few or more degrees above room temperature (e.g. 60-100 degrees Fahrenheit). Sometimes the ejected material (as sparks) may reach about 115 degrees Fahrenheit near a spout of the device (e.g. top of ejection tube). The granularity of the material may be a powder being having a US mesh value of 80-100 as a non-limiting example, having a consistency of course ground culinary pepper.

Turning back to the figures, heating pipe 4, is usually a metal pipe. An outside of the heating pipe 4 has a heating coil 5, where this heating coil is used for the heating of existing structures. After electrifying the heating coil 5, the heating pipe 4 becomes hot, the metal tube temperature rises to about 600° Celsius.

Specifically, the blower 1 is connected to a diverging mechanism 23, and a side of the diverging mechanism 23 is provided with a tuyere 25 which is connected to the duct 6 through a duct joint 61 which is connected to an upper portion of the silo 3, to the silo 3 to provide wind, in order to achieve the purpose of transporting cold fireworks raw materials.

The silo 3 is provided with a cold fireworks material 32, such as a composite metal powder such as titanium powder or other metal particles, and an upper part of the cold fireworks material 32 has a closed chamber 31. The duct 6 is connected to the upper portion of the silo 3 so as to facilitate the wind blowing of the cold air fireworks 32 and the conveying pipe 41 on the side of the silo 3 to facilitate the delivery of the cold fireworks material 32 to the heating pipe 4. Thus, the blower 1 is capable of effectively blowing the cold fireworks material 32 (metal powder or metal particles, usually using composite titanium powder) such that the metal powder or metal particles can smoothly enter the heating pipe 4.

Figure 2:
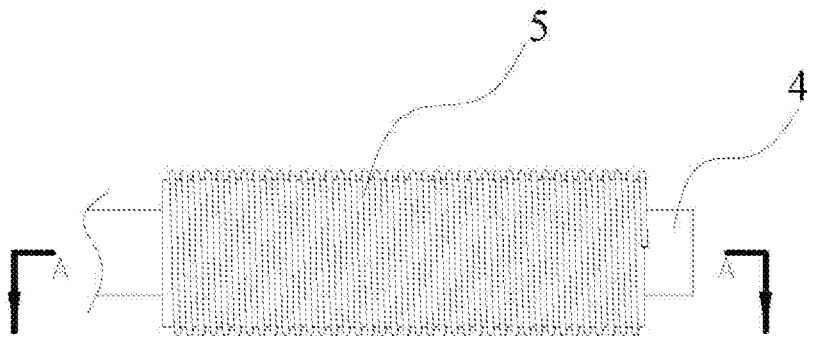
FIG. 2 is a schematic structural view of a heating unit realized by the present invention.
Figure 3:
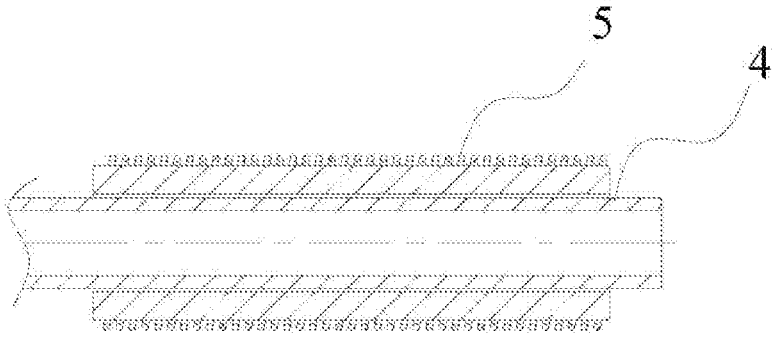
FIG. 3 is a cross-sectional view taken along the line A-A in FIG. 2.

As shown in FIGS. 2 and 3, the conveying pipe 41 is a tubular structure having a first end connected to the silo 3 and a second end connected to the heating pipe 4, wherein a middle side wall of the conveying pipe 41 is opened. There is a pressure relief port 42 through which the pressure of the wind force can be released to allow the cold fireworks raw material 32 to enter into the heating pipe 4 in a free-fall manner.

Figure 4:
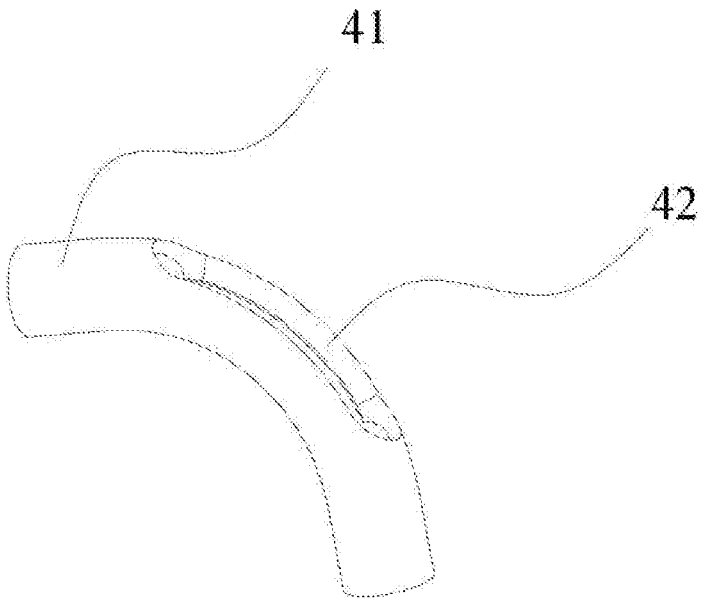
FIG. 4 is a schematic view showing the structure of a conveying pipe according to the present invention.
Figure 5:
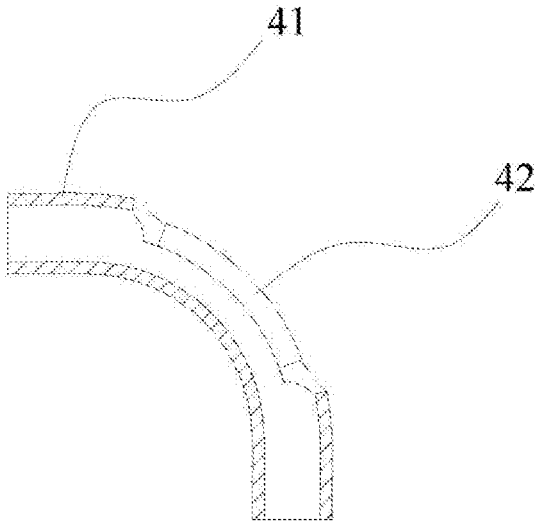
FIG. 5 is a cross-sectional view of the conveying pipe of the present invention.

As shown in FIGS. 4 and 5 the eruptive apparatus is composed of a heating coil 5 and a heating pipe 4, and the heating pipe 4 is a hollow metal pipe, and the heating coil 5 is wound around the pipe 4, where the heating coil is a commonly used heating wire.

The heating pipe 4 is vertically arranged to be connected to the conveying pipe 41 and an outer wall of the conveying pipe 41 is provided with a pressure relief port 42 for releasing the wind pressure in the conveying pipe 41. It is possible to reduce the descending speed of the metal powder or the metal particles by the action of gravity, so that the metal powder or the metal particles have sufficient time to be heated. In another implementation, in order to prevent the cold fireworks material from being ejected from the conveying pipe 41, the pressure relief port 42 is covered with a filter (not shown) which can block the metal powder or metal particles in the cold fireworks raw material.

The eruptive apparatus is connected with a regulating pipe 7, and the regulating pipe 7 is connected with the eruptive unit, and the cold fireworks raw material heated by the heating unit is sent to the eruptive unit via the regulating pipe 7 so that the eruption unit can emit cold fireworks.

Figure 6:
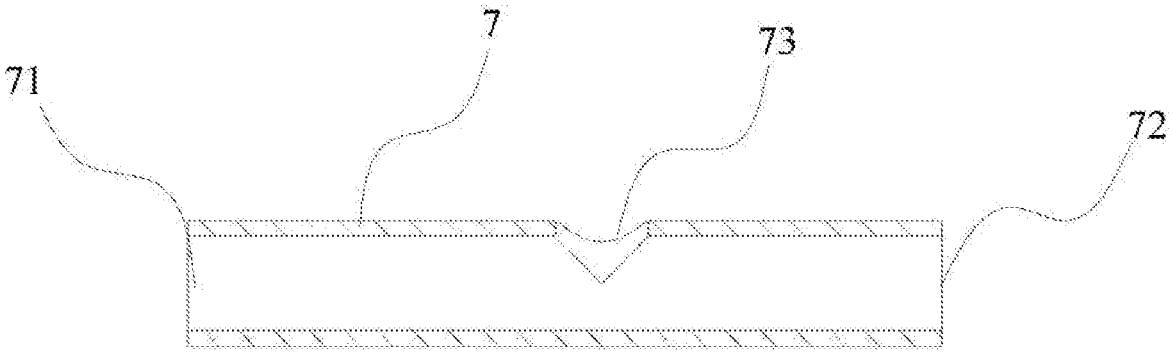
FIG. 6 is a cross-sectional view of a regulating pipe according to the present invention.

As shown in FIG. 6, the regulating pipe 7 is connected to a lower portion of the heating pipe 4 through a connector 73, and a first end (inner end 72) of the regulating pipe 7 is connected to a lower portion of the regulating pipe 7. An outer end 71 is suspended and has an opening. The metal powder or metal particles heated by the heating pipe 4 are introduced into the eruptive unit via the regulating pipe 7.

Figure 7:
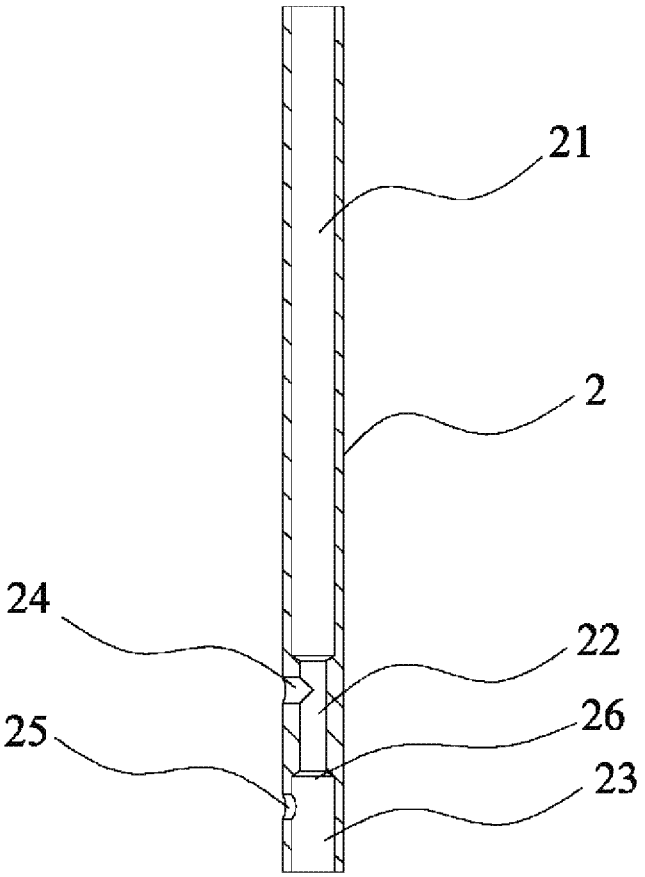
FIG. 7 is a cross-sectional view of an eruption tube of the present invention.

As shown in FIG. 7, the eruption pipe 2 has a different inner diameter, and the eruption pipe 2 has two sections (an upper section 21, and a lower section 22), the upper section 21 and the lower section 22 have different inner diameters, and the lower section 22 is smaller than the inner diameter of the upper section 21.

At the same time, the inner end 72 of the regulating pipe 7 is connected to the lower section 22 of the eruption pipe 2 and the inner diameter of the regulating pipe 7 is larger than the inner diameter of the lower portion 22 of the eruption pipe 2. The eruption pipe 2 is capable of generating suction and sucks the heated cold spark material (the burned metal powder or the metal particles) into the eruption pipe 2, thereby producing the effect of cold fireworks eruption.

As shown in FIG. 1 the air outlet of the blower 1 is provided with a diverging mechanism 23 having two tuyere ports, a first tuyere 25 connected to the duct joint 61 and the duct joint 61 being connected to the duct 6. And a second tuyere 26 is connected to the lower section 22 of the eruption pipe 2.

We know that the Bernoulli equation is:

$$p + \frac{1}{2}\rho v^2 + \rho gh = C$$

where, P is the kinetic energy, $\rho V^2$ is the potential energy potential, ρgh is the pressure potential energy. Kinetic energy+gravity potential+pressure potential=constant. In the ideal fluid, the flow rate of large pressure is smaller than the flow rate of small pressure. Thus, in the implementation of the present invention, the air is blown out of the diverging mechanism 23, where a portion of which enters the lower section 22, and a portion of the air is blown into the silo 3 via the duct 6, by means of the Bernoulli principle and the hydrodynamic simulation experiment. The wind entering the silo 3 forms turbulence in the closed chamber 31, blows out the composite titanium powder, heats the heating pipe 4 and generates a spark, and the spark falls into the regulating pipe 7. The regulating pipe 7 is connected to the lower section 22, and since the inner diameter of the lower section 22 is small, the air flow rate is fast and the pressure is small, and the spark is sucked from the regulating pipe 7 into the lower section 22 and blown through the upper section 21.

In short, the invention can be realized by several simple eruption units, storage units and heating units. It has the characteristics of simple structure, is easy to realize, has a small volume and good handling, and is convenient for transportation and installation. The use will not take up too much space (for example, it can be buried in the stage, not exposed to the stage surface, not affecting the stage performance). The equipment through the structural improvement, provides safety and environmental protection, to achieve low cost advantages.

The foregoing is intended only as a preferred embodiment of the present invention and is not intended to limit the invention, and any modifications, equivalent substitutions and improvements within the spirit and principles of the invention are intended to be encompassed by the invention.

Since many modifications, variations, and changes in detail can be made to the described preferred embodiments of the invention, it is intended that all matters in the foregoing description and shown in the accompanying drawings be interpreted as illustrative and not in a limiting sense. Thus, the scope of the invention should be determined by the appended claims and their legal equivalents.

What is claimed is:

1. A special effects device for ejecting sparks, the device comprising:

an eruption unit;

an activation unit;

a power unit;

a storage unit configured to store a source material;

wherein the power unit is connected to the storage unit and the storage unit is connected to the activation unit;

wherein the power unit is configured to transmit the source material from the storage unit to the activation unit;

wherein the activation unit is configured to excite the source material to an excited state and send excited source material to the eruption unit;

wherein the eruption unit is configured to eject the excited source material via pressure applied by the power unit;

wherein the source material is configured to adopt the appearance of a spark by being subjected to airflow while the source material is in an excited state; and wherein the power unit is connected to an upper part of the storage unit through a duct to such that the source material smoothly enters the activation unit.

2. The device of claim 1, wherein the source material includes a powdered metal.

3. The device of claim 1, wherein exciting the source material causes the source material to be heated inside the device.

4. The device of claim 1, wherein exciting the source material causes the source material to be heated to a glowing state inside the device.

5. The device of claim 1, wherein the power unit is configured to concurrently transmit source material from the storage unit to the activation unit and apply pressure to the eruption unit to eject excited source material received from the activation unit.

6. The device of claim 1, wherein a diverging mechanism is included having two tuyere ports, a first tuyere port being connected to the duct that connects the power unit to the storage unit, and a second tuyere port connected to a lower section of an eruption pipe of the eruption unit.

7. A special effects device for ejecting sparks, the device of claim 1, comprising:

an eruption unit;

an activation unit;

a power unit;

a storage unit configured to store a source material;

wherein the power unit is connected to the storage unit and the storage unit is connected to the activation unit; wherein the power unit is configured to transmit the source material from the storage unit to the activation unit;

wherein the activation unit is configured to excite the source material to an excited state and send excited source material to the eruption unit;

wherein the eruption unit is configured to eject the excited source material via pressure applied by the power unit;

wherein the source material is configured to adopt the appearance of a spark by being subjected to airflow while the source material is in an excited state;

wherein a conveying pipe is connected to the storage unit, and the conveying pipe is connected to the activation unit such that the source material is discharged through a side of the storage unit;

wherein the activation unit includes a heating coil and a heating pipe, and the heating pipe is vertically arranged to be connected to the conveying pipe, and an outer wall of the conveying pipe includes a discharge port such that pneumatic pressure in the conveying pipe is released such that the source material has sufficient time to be excited in the activation unit.

8. A special effects device for ejecting sparks, the device comprising:

an eruption unit;

an activation unit;

a power unit;

a storage unit configured to store a source material;

wherein the power unit is connected to the storage unit and the storage unit is connected to the activation unit;

wherein the power unit is configured to transmit the source material from the storage unit to the activation unit;

wherein the activation unit is configured to excite the source material to an excited state and send excited source material to the eruption unit;

wherein the eruption unit is configured to eject the excited source material via pressure applied by the power unit;

wherein the source material is configured to adopt the appearance of a spark by being subjected to airflow while the source material is in an excited state;

wherein the activation unit is connected to an adjusting mechanism, and the adjusting mechanism is connected to the eruption unit, such that the source material that is excited by the activation unit is sent to the eruption unit by a regulating mechanism such that the eruption unit can eject excited source material, wherein the adjusting mechanism includes a regulating pipe, where a middle of the regulating pipe is connected to a lower part of an activation tube of the activation unit, and such that a first end of the regulating pipe is connected to the eruption unit, and a second end of the regulating pipe is open.

9. The device of claim 8, wherein the regulating pipe is connected to a lower portion of the eruption unit, and an inner diameter of the regulating pipe is larger than an inner diameter of the lower portion of the eruption unit.

10. A special effects device for ejecting sparks, the device comprising:

an eruption unit;

an activation unit;

a power unit;

a storage unit configured to store a source material;

wherein the power unit is connected to the storage unit and the storage unit is connected to the activation unit; p1 wherein the power unit is configured to transmit the source material from the storage unit to the activation unit;

wherein the activation unit is configured to excite the source material to an excited state and send excited source material to the eruption unit;

wherein the eruption unit is configured to eject the excited source material via pressure applied by the power unit;

wherein the source material is configured to adopt the appearance of a spark by being subjected to airflow while the source material is in an excited state;

wherein the eruption unit is a vertically arranged pipe having at least an upper segment and a lower segment, each segment having a different inner diameter and an inner diameter of the lower section being smaller than an inner diameter of the upper section.

11. A special effects device for ejecting sparks, the device comprising:

an eruption unit;

an activation unit;

a power unit;

a storage unit configured to store a source material;

wherein the power unit is connected to the storage unit and the storage unit is connected to the activation unit;

wherein the power unit is configured to transmit the source material from the storage unit to the activation unit;

wherein the activation unit is configured to excite the source material to an excited state and send excited source material to the eruption unit;

wherein the eruption unit is configured to eject the excited source material via pressure applied by the power unit;

wherein the source material is configured to adopt the appearance of a spark by being subjected to airflow while the source material is in an excited state;

wherein the power unit is connected to an upper part of the storage unit through a duct to such that the source material smoothly enters the activation unit wherein the source material includes a powdered metal;

wherein exciting the source material causes the source material to be heated inside the device;

wherein exciting the source material causes the source material to be heated to a glowing state inside the device; and wherein the power unit is configured to concurrently transmit source material from the storage unit to the activation unit and apply pressure to the eruption unit to eject excited source material received from the activation unit.

12. A special effects device for ejecting sparks without combustion, the device comprising:

an eruption unit;

an activation unit;

a power unit;

a storage unit configured to store a source material;

wherein the power unit is connected to the storage unit and the storage unit is connected to the activation unit;

wherein the power unit is configured to transmit the source material from the storage unit to the activation unit;

wherein the activation unit is configured to excite the source material to an excited state and send excited source material to the eruption unit;

wherein the eruption unit is configured to eject the excited source material via pressure applied by the power unit;

wherein the source material is configured to adopt the appearance of a spark by being subjected to airflow while the source material is in an excited state;

wherein the source material includes a powdered metal;

wherein exciting the source material causes the source material to be heated inside the device;

wherein exciting the source material causes the source material to be heated to a glowing state inside the device;

wherein the power unit is configured to concurrently transmit source material from the storage unit to the activation unit and apply pressure to the eruption unit to eject excited source material received from the activation unit; and wherein the power unit is connected to an upper part of the storage unit through a duct to such that the source material smoothly enters the activation unit.

13. The device of claim 12, wherein a conveying pipe is connected to the storage unit, and the conveying pipe is connected to the activation unit such that the source material is discharged through a side of the storage unit.

14. The device of claim 13, wherein the activation unit includes a heating coil and a heating pipe, and the heating pipe is vertically arranged to be connected to the conveying pipe, and an outer wall of the conveying pipe includes a discharge port such that pneumatic pressure in the conveying pipe is released such that the source material has sufficient time to be excited in the activation unit.

15. The device of claim 12, wherein the activation unit is connected to an adjusting mechanism, and the adjusting mechanism is connected to the eruption unit, such that the source material that is excited by the activation unit is sent to the eruption unit by a regulating mechanism such that the eruption unit can eject excited source material, wherein the adjusting mechanism includes a regulating pipe, where a middle of the regulating pipe is connected to a lower part of an activation tube of the activation unit, and such that a first end of the regulating pipe is connected to the eruption unit, and a second end of the regulating pipe is open.

16. The device of claim 12, wherein the eruption unit is a vertically arranged pipe having at least an upper segment and a lower segment, each segment having a different inner diameter and an inner diameter of the lower section being smaller than an inner diameter of the upper section.

17. The device of claim 15, wherein the regulating pipe is connected to a lower portion of the eruption unit, and an inner diameter of the regulating pipe is larger than an inner diameter of the lower portion of the eruption unit.

18. The device of claim 12, wherein a diverging mechanism is included having two tuyere ports, a first tuyere port being connected to the duct that connects the power unit to the storage unit, and a second tuyere port connected to a lower section of an eruption pipe of the eruption unit.

* * * * *